US010774554B1

(12) United States Patent
Foster et al.

(10) Patent No.: US 10,774,554 B1
(45) **Date of Patent: *Sep. 15, 2020**

(54) FREEFORM POOL

(71) Applicant: Trojan Leisure Products, LLC, Albany, NY (US)

(72) Inventors: Charles M. Foster, Schenectady, NY (US); David A. Steele, Gansevoort, NY (US); Collin J. Sirco, Ballston Lake, NY (US)

(73) Assignee: Trojan Leisure Products, LLC, Albany, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/421,635

(22) Filed: May 24, 2019

Related U.S. Application Data

(63) Continuation of application No. 14/629,129, filed on Feb. 23, 2015, now Pat. No. 10,344,490, which is a continuation of application No. 14/165,264, filed on Jan. 27, 2014, now abandoned.

(60) Provisional application No. 61/756,722, filed on Jan. 25, 2013.

(51) Int. Cl.
*E04H 4/04* (2006.01)
*E04H 4/00* (2006.01)

(52) U.S. Cl.
CPC ..... *E04H 4/0043* (2013.01); *E04H 4/005* (2013.01)

(58) Field of Classification Search
CPC ..... E02D 29/0225; E02D 29/0233; E04H 4/0018; E04H 4/0031; E04H 4/0037; E04H 4/0043; E04H 4/005; E04G 21/26; E04G 25/00; E04G 25/02; E04G 23/04
USPC ..... 52/127.2, 169.7, 169.8; 4/506, 513
See application file for complete search history.

(56) References Cited

U.S. PATENT DOCUMENTS

| | | | |
|---|---|---|---|
| 3,142,069 | A | 7/1964 | O'Connell et al. |
| 3,274,621 | A | 9/1966 | Diemond et al. |
| 3,298,038 | A | 1/1967 | O'Connell et al. |
| 3,443,263 | A | 5/1969 | Minasy |
| 3,518,705 | A | 7/1970 | Cudney |
| 3,530,512 | A | 9/1970 | McBride |
| 3,593,348 | A | 7/1971 | Toerge et al. |
| 3,974,605 | A | 8/1976 | Beatty et al. |
| 3,975,874 | A | 8/1976 | Witte |
| 4,047,340 | A | 9/1977 | Witte et al. |
| 4,055,922 | A | 11/1977 | Ellington et al. |

(Continued)

FOREIGN PATENT DOCUMENTS

| | | | |
|---|---|---|---|
| CA | 769339 | A | 10/1967 |
| JP | 1207572 | A | 8/1989 |

OTHER PUBLICATIONS

"Alpha Steel Wall Above Ground Pool Kits," www.inyopools.com/above_ground_pools_alpha.aspx, 3 pages, 2012.

(Continued)

*Primary Examiner* — William V Gilbert
(74) *Attorney, Agent, or Firm* — Tech Valley Patent, LLC; John Pietrangelo

(57) ABSTRACT

A swimming pool consisting of a plurality of panels that withstands water pressure in both a concave and convex configuration to create any freeform shape or size. Each panel consists of an adhered wall of skinning of metal or plastic over expanded polystyrene or expanded urethane foam. The density of the foam is adjusted as necessary to increase the strength of the wall based on static loading of water when swimming pool is assembled as a whole and fully filled with water.

11 Claims, 15 Drawing Sheets

(56) References Cited

U.S. PATENT DOCUMENTS

| | | | |
|---|---|---|---|
| 4,464,802 | A | 8/1984 | Glonek et al. |
| 4,501,100 | A | 2/1985 | Corna et al. |
| 4,566,141 | A | 1/1986 | Mahoney |
| RE32,181 | E | 6/1986 | Glonek et al. |
| 4,782,538 | A | 11/1988 | Chisholm et al. |
| 5,325,644 | A | 7/1994 | Cornelius |
| 5,522,188 | A | 6/1996 | Cornelius |
| 5,875,500 | A | 3/1999 | Shaanan et al. |
| 5,884,347 | A | 3/1999 | Yurchision et al. |
| 6,378,144 | B1 | 4/2002 | Yurchision |
| 6,421,846 | B1 | 7/2002 | Shaanan et al. |
| 6,782,668 | B2 | 8/2004 | Bruce |
| 7,739,842 | B1 | 6/2010 | Hodsdon et al. |
| 8,028,476 | B1 | 10/2011 | Alford |
| 8,074,406 | B2 | 12/2011 | Ksenych et al. |
| 2002/0011549 | A1 | 1/2002 | Tkalec |
| 2004/0078884 | A1 | 4/2004 | Pugliese et al. |
| 2007/0144082 | A1 | 6/2007 | Kantor |
| 2008/0104745 | A1 | 5/2008 | Beaudoin et al. |
| 2009/0151066 | A1 | 6/2009 | Sullivan |
| 2010/0031434 | A1 | 2/2010 | Tassone et al. |
| 2010/0126085 | A1 | 5/2010 | Nelson |

OTHER PUBLICATIONS

"Above Ground or Inground Freestanding Block Kits," www.agbudget.co.uk/aboveprices.htm, 3 pages, 2012.

"New Lagoon Pool—Blountsville, AL" www.troublefreepool.com/new-lagoon-in-blountsville-al-154625.html, 36 pages, 2012.

Office Action for Parent U.S. Appl. No. 14/165,264 dated Jul. 14, 2014, 15 pages.

Office Action for Parent U.S. Appl. No. 14/165,264 dated Oct. 30, 2014, 11 pages.

EZ Panel Pool Brochure, 2 pages, dated 2010.

Aquawood Pools webpages, www.aquawoodinsulatedpools.com, 3 pages, dated 2014.

Hammel, Cailley, "An Aboveground Free-for-all," Aqua Magazine, Jan. 2015, 3 pages.

Office Action for Parent U.S. Appl. No. 14/629,129 dated May 22, 2015, 20 pages.

Office Action for Parent U.S. Appl. No. 14/629,129 dated Jul. 28, 2015, 19 pages.

Office Action for Parent U.S. Appl. No. 14/629,129 dated Sep. 18, 2018, 14 pages.

Office Action for Parent U.S. Appl. No. 14/629,129 dated Mar. 14, 2019, 5 pages.

FREEFORM POOL

CROSS-REFERENCE TO RELATED APPLICATIONS

The present application is a continuation application of pending U.S. application Ser. No. 14/165,264, filed on Jan. 27, 2014, now U.S. Patent XYZ, which claims priority to U.S. Provisional Application Ser. No. 61/756,722, filed Jan. 25, 2013, the disclosures of which are incorporated by reference herein in their entirety.

BACKGROUND OF THE INVENTION

The present invention relates to swimming pools, and more particularly free form swimming pools.

Free form swimming pools require particular structural detail to account for the stress imparted to the curved walls when the pool is filled with water. Without appropriate bracing, convex walls will shift, buckle, and ultimately fail due to the distribution of the static loading.

SUMMARY OF THE INVENTION

A swimming pool consisting of a plurality of panels that withstands water pressure in both a concave and convex configuration to create any freeform shape or size. Each panel consists of an adhered wall of skinning of metal or plastic over expanded polystyrene or expanded urethane foam. The density of the foam is adjusted as necessary to increase the strength of the wall based on static loading of water when swimming pool is assembled as a whole and fully filled with water. Panels with water pressure in the convex direction have adjusters attached at the bottom to allow for vertical movement during installation and horizontal tabs (anchor plate) locking into a concrete foundation as the pool is assembled. The swimming pool can be installed fully above ground, semi-in-ground or fully in-ground.

According to one aspect, an embodiment of the present invention comprises a section of a swimming pool wall comprising: a panel, having a first and a second surface a top and a bottom and at least one anchor extending radially outward from at least one surface of the panel, and dimensioned to, when in use, lock the panel into a concrete foundation.

According to another aspect, a section comprising at least one adjuster extending downward from the bottom of the panel, adapted to permit vertical movement during the panel's installation.

According to another aspect a section comprising at least one a-frame support attached to the panel.

According to another aspect, the A-frame support comprises a post, having a top and a bottom, attached to and extending along the second surface of the panel; a crossmember, extending radially outward from second surface of the panel and attached to the bottom of the post, wherein the crossmember locks into the concrete foundation when in use; a leg, having a first end a second end, wherein the first end is attached to the post and the second end is attached to the crossmember.

According to another aspect, the anchor is a tab.

According to another aspect, the anchor is a plate.

According to another aspect, the panel comprises a skinning over a foam interior.

According to another aspect, the panel is bowed.

According to another aspect, the curve of the panel is bowed outward, relative to the interior of the pool when in use.

According to another aspect, the anchor extends radially outward from the bottom of the panel.

DETAILED DESCRIPTION

Figure 1:
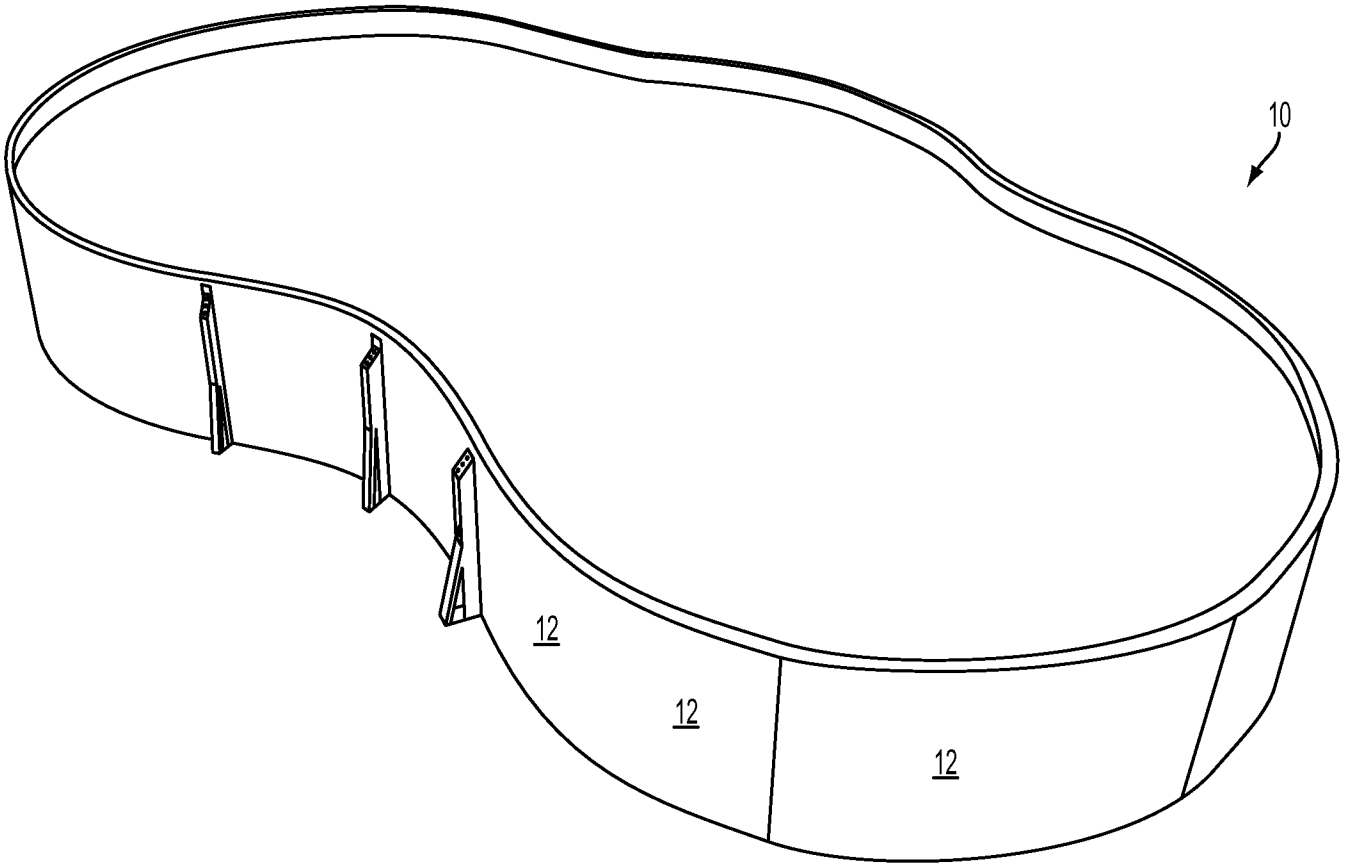
FIG. 1 is a perspective view/photograph of a swimming pool including a plurality of panels in accordance with an embodiment of the present invention.
Figure 3:
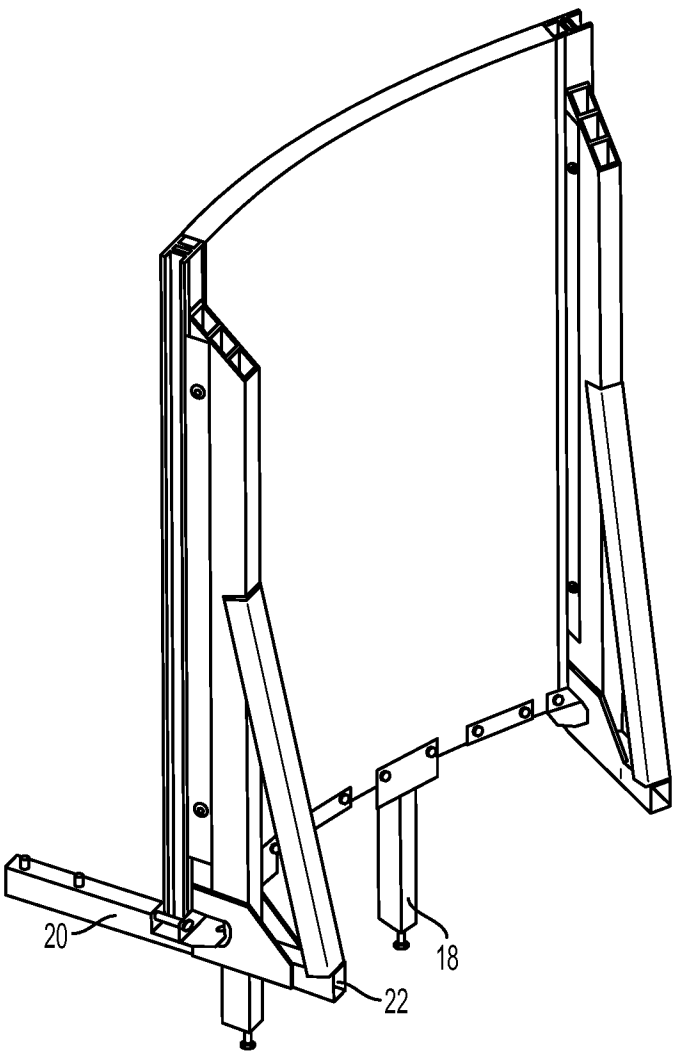
FIG. 3 is a front perspective of a pool panel of the pool assembly of FIG. 1 in accordance with an embodiment of the present invention.
Figure 2:
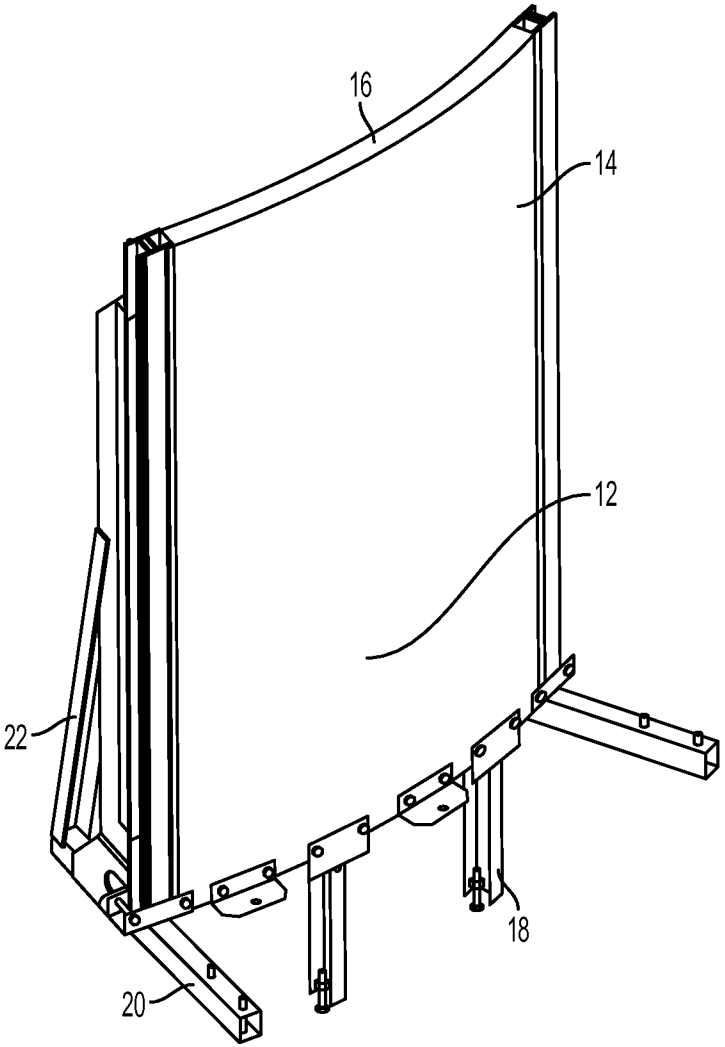
FIG. 2 is a rear perspective view of a pool panel of the pool assembly of FIG. 1 in accordance with an embodiment of the present invention.

Referring to the drawings wherein like reference numerals refer to like parts throughout, there is seen in FIG. 1 a swimming pool 10 comprising a plurality of panels 12, most of which are either concave or convex. Each panel comprises a wall of skinning 14 of plastic or metal formed over expanded polystyrene or expanded urethane foam 16. The density of the foam is selected to increase the strength of the wall based on the static load conditions of water when the pool is fully assembled (thus, dependent on overall size volume of the pool). Those panels 12 with water pressure being asserted in the convex direction have adjusters 18 attached at their bottom to permit vertical movement during installation, horizontal tabs 20 (or an anchor plate) locking into a concrete foundation as the pool is assembled, and A-frame supports 22. Pool 10 can be a fully above ground pool, a partially above ground pool, or an entirely in-ground pool.

Figure 4B:
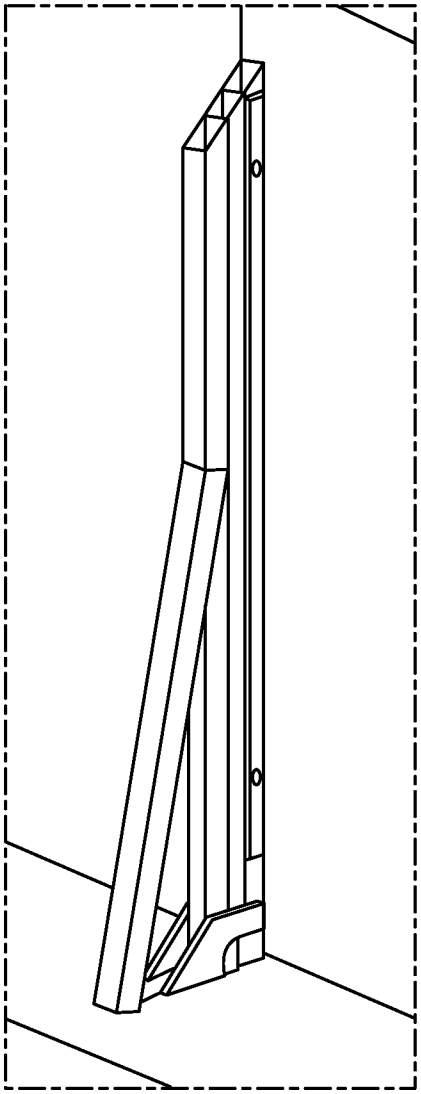
FIG. 4B is a diagram/perspective view of A-frame supports of the pool assembly of FIG. 4A in accordance with an embodiment of the present invention.
Figure 4A:
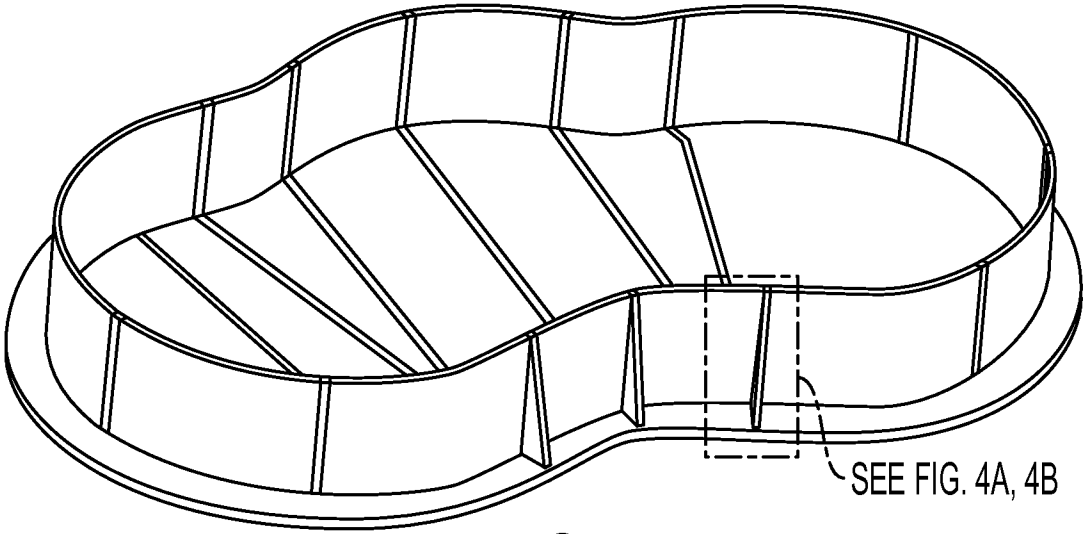
FIG. 4A is a diagram/perspective view of a pool assembly including a plurality of panels in accordance with an embodiment of the present invention.
Figure 4C:
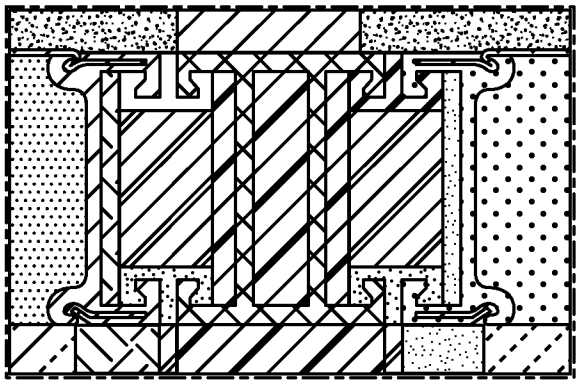
FIG. 4C is a diagram/illustration of a panel joint of the pool assembly of FIG. 4A in accordance with an embodiment of the present invention.

FIG. 4A shows a diagram of the assembled swimming pool, including pool wall panels. FIG. 4B shows a diagram of the A-frame support, and FIG. 4C shows a diagram of the panel joint when in use.

FIGS. 4-16 show a structural analysis of a free-form 18'×32' pool constructed from an embodiment of the present invention, to demonstrate the structural integrity of such a pool. To summarize the results, the maximum deflection in the assembly is 0.057", and the maximum stress is 8,259 psi, which occurs at the aluminum sheet metal. The maximum stress is still well below the tensile yield strength of the pool. The resulting factor of safety for the aluminum A-frame supports is 3.03, the aluminum spline is 3.78, and the polystyrene foam is 20. These figures demonstrate that the embodiment of the invention is safe under the fully filled water condition.

The following assumptions were made in the analysis: (1) linear material properties of aluminum and polystyrene are assumed for the purpose of the analysis; (2) 18'×32' Lagoon Swimming Pool is considered filled with water; and (3) liquid specific gravity is assumed to be equal to water density. All units are English units. Material properties were simulated with the properties shown in Table 1:

TABLE 1

| Material | Young's Modulus (psi) | Poisson's Ratio | Tensile Yield Strength (psi) |
|---|---|---|---|
| Aluminum | 10E+6 | 0.33 | 21029.73 |
| Polystyrene | 5.221E+5 | 0.34 | 6671.7-8702.3 |

Figure 5:
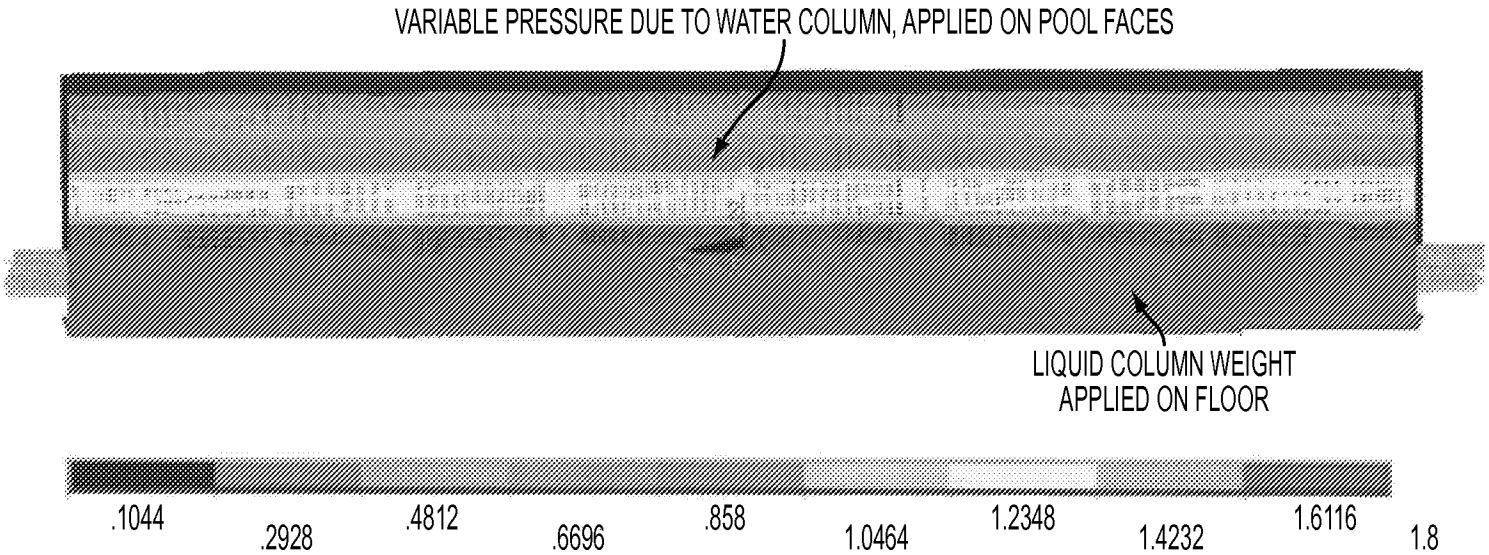
FIG. 5 is a diagram/illustration of loads and boundary conditions of a pool assembly in accordance with an embodiment of the present invention.

FIG. 5 shows the loads and boundary conditions of the interior surface of the pool. The graph demonstrates that the liquid column applied on the floor was simulated to be 1.8 psi, and a variable pressure was simulated on the pool faces, ranging from 0.1044 to 1.4232 psi.

Figure 6:
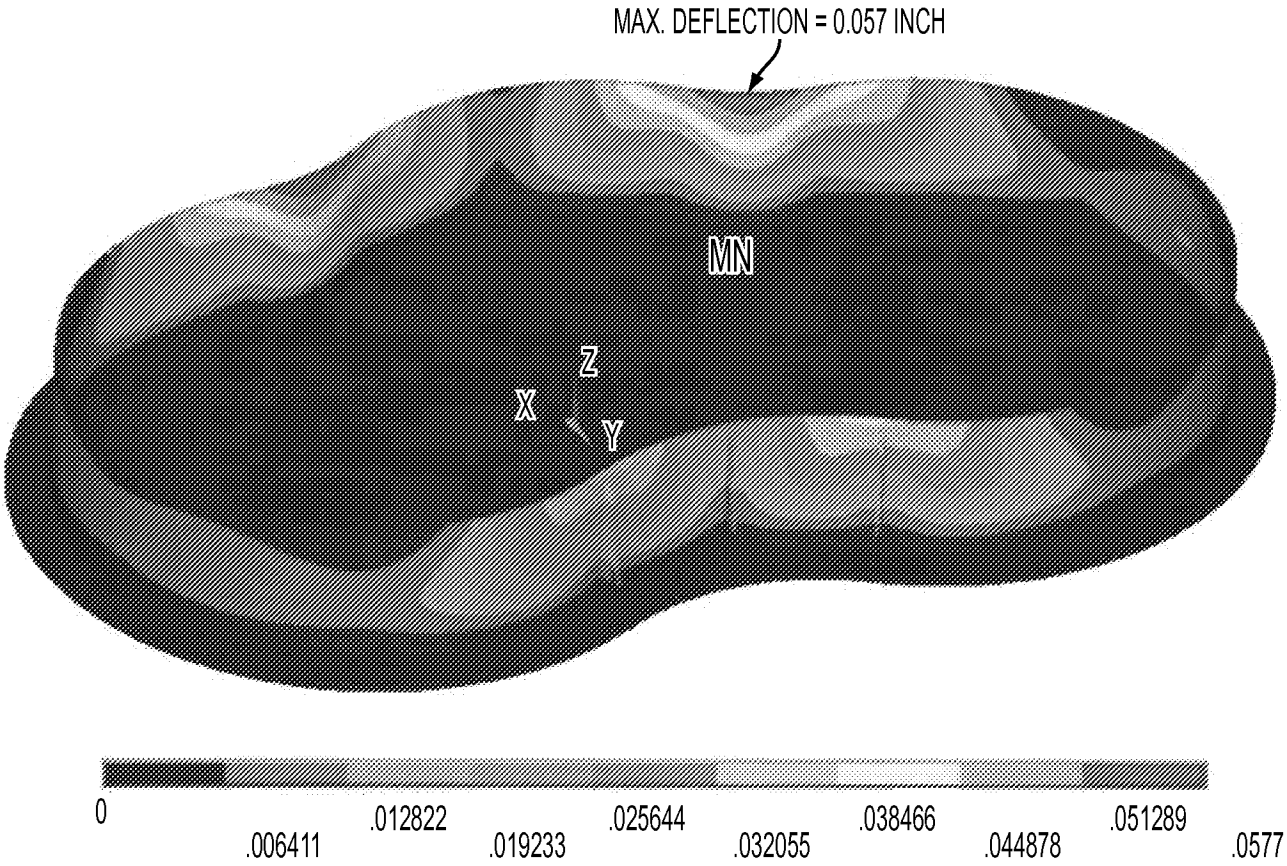
FIG. 6 is a deflection plot illustration of a pool assembly from a front perspective view in accordance with an embodiment of the present invention.
Figure 7:
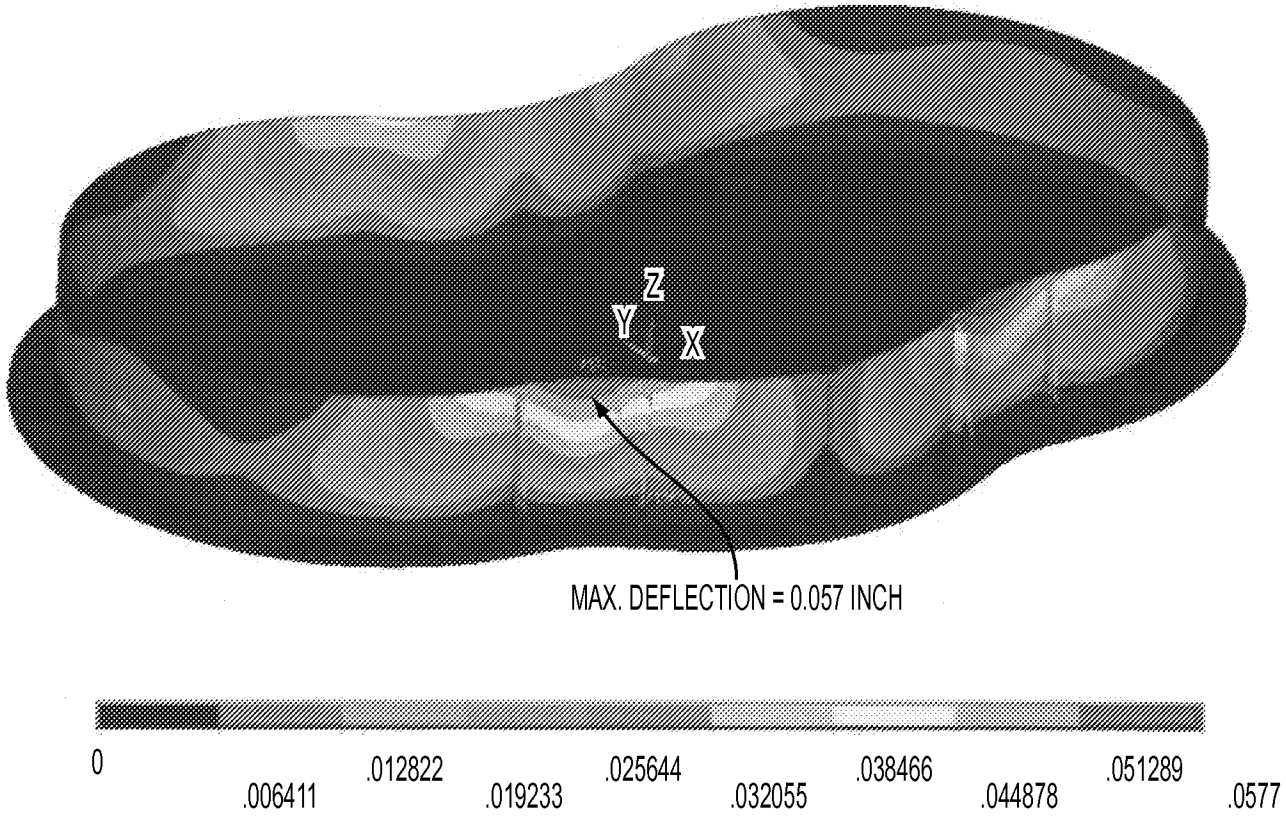
FIG. 7 is a deflection plot illustration of a pool assembly from a rear perspective view in accordance with an embodiment of the present invention.
Figure 8:
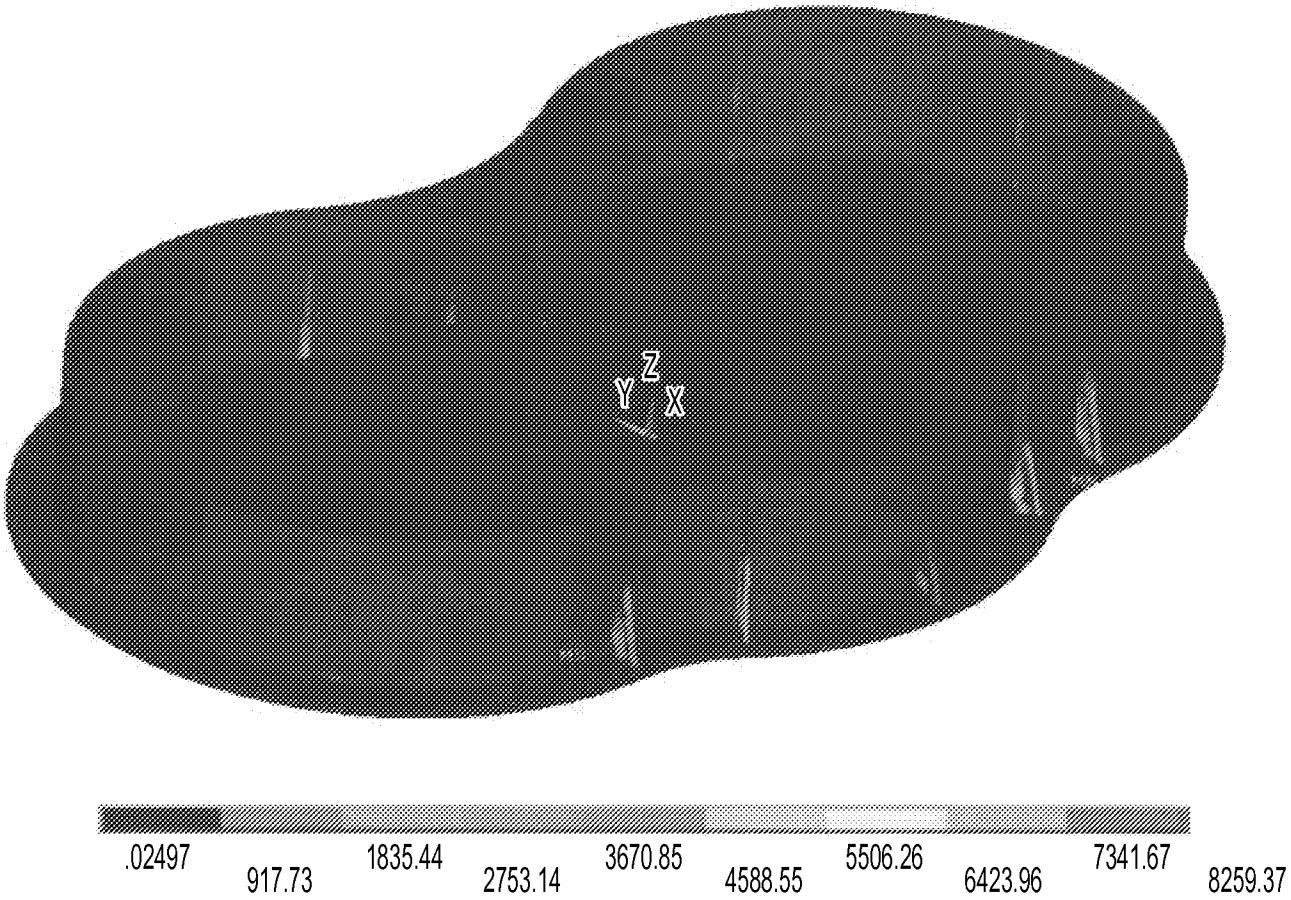
FIG. 8 is a von Mises stress plot illustration of a pool assembly in accordance with an embodiment of the present invention.

FIGS. 6 and 7 are deflection plots of the pool from opposite sides. Both deflection plots demonstrate that the maximum deflection is 0.057 inches at the apex of the pool wall's convex curves.

Figure 9:
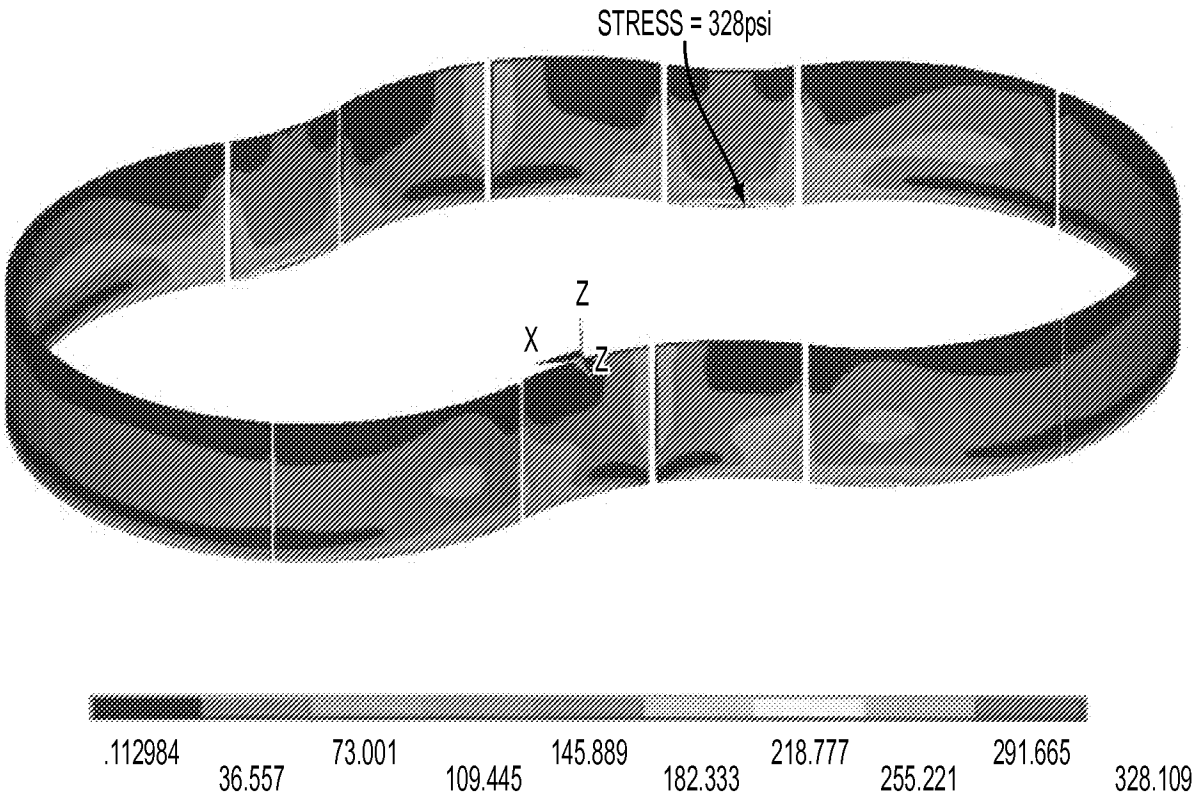
FIG. 9 is a von Mises stress plot illustration of a polystyrene foam layer of a pool assembly in accordance with an embodiment of the present invention.

FIGS. 8-16 show von-Mises stress plots (in psi) of various components of the structure of the pool assembly. FIG. 9 shows the stress of the polystyrene layer is 328 psi. Assuming a tensile yield strength of 6671.7 psi, results in a factor of safety of 20 for the polystyrene layer per the equation shown in Table 2 below.

TABLE 2

$$\text{SAFETY FACTOR} = \frac{\text{YIELD STRENGTH}}{\text{WORKING STRESS}} = \frac{6671.7}{328} = 20$$

Figure 10B:
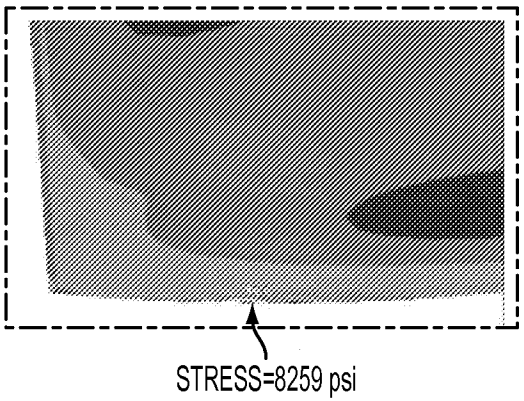
FIG. 10B is a magnified view of a "cutout" aluminum panel portion as shown in FIG. 10A in accordance with an embodiment of the present invention.
Figure 10A:
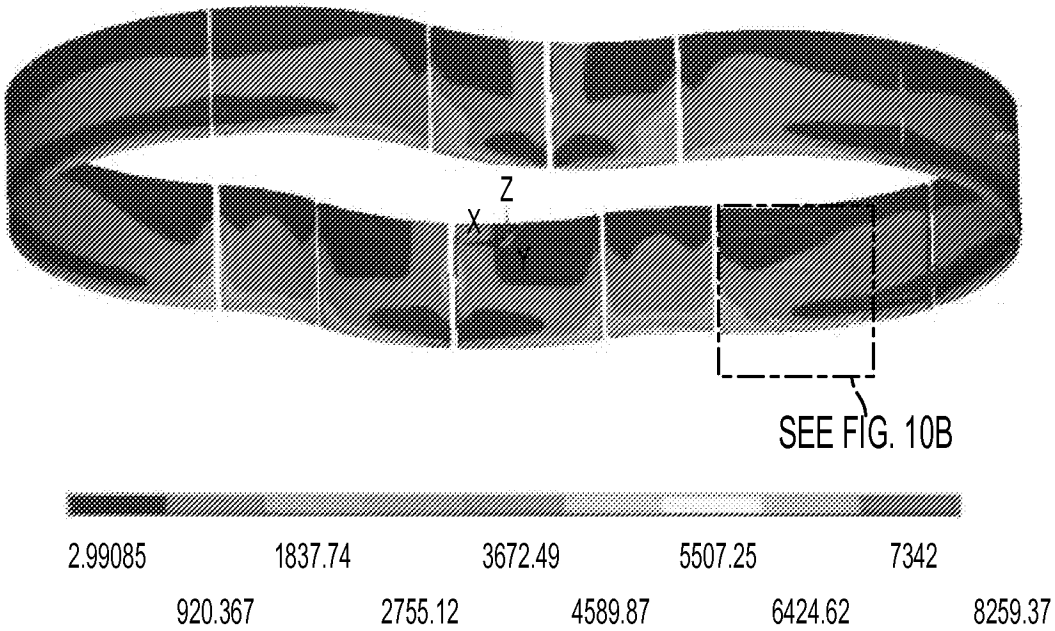
FIG. 10A is a von Mises stress plot illustration of aluminum panels of a pool assembly in accordance with an embodiment of the present invention.

FIGS. 10A-B show the stress of a concave aluminum panel is 8259 psi. Assuming the tensile yield strength is 21029.73, results in a factor of 2.55 for the concave aluminum panel per the equation shown in Table 3 below.

TABLE 3

$$\text{SAFETY FACTOR} = \frac{\text{YIELD STRENGTH}}{\text{WORKING STRESS}} = \frac{21029.73}{8259} = 2.55$$

Figure 11:
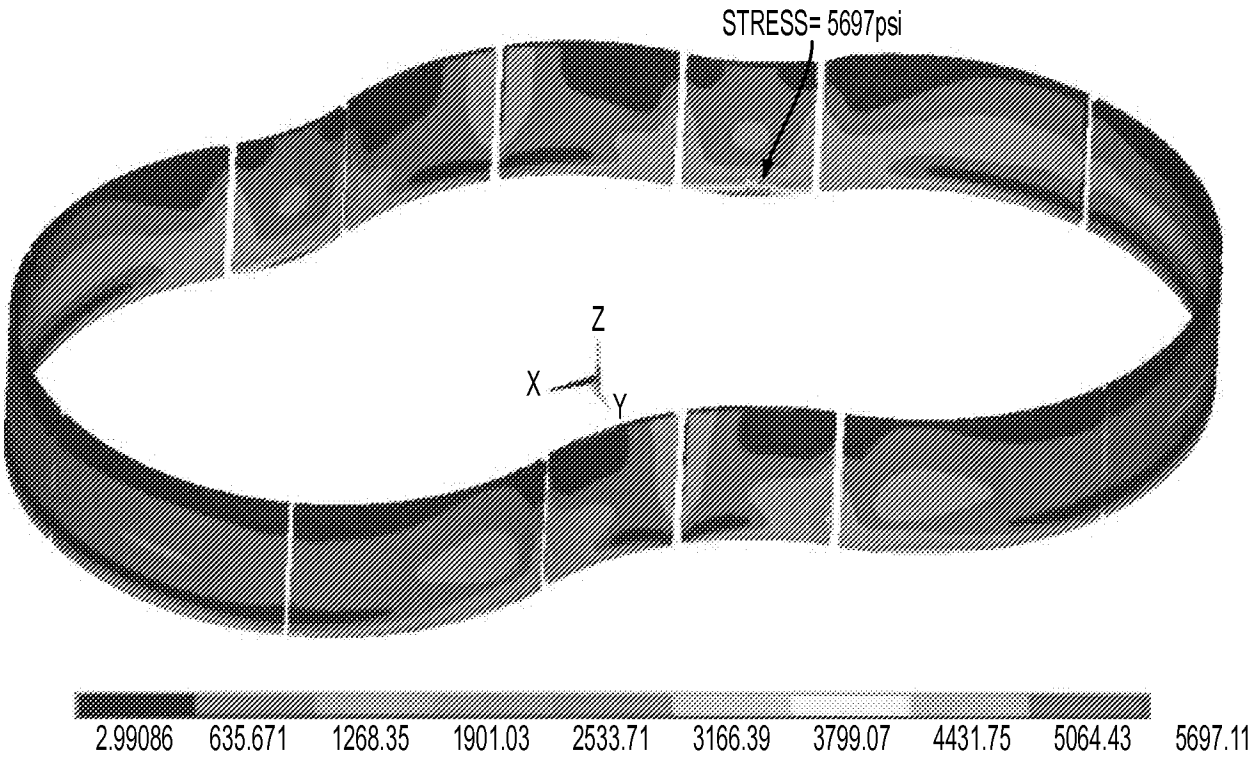
FIG. 11 is a von Mises stress plot illustration of aluminum panels of a pool assembly in accordance with an embodiment of the present invention.
Figure 12C:
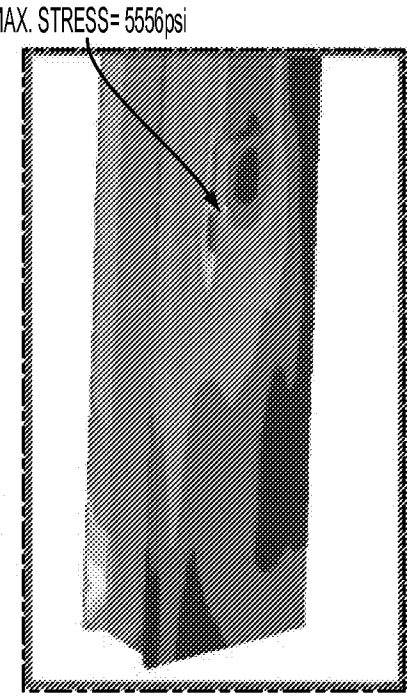
FIG. 12C a magnified view of the aluminum spline as shown in FIG. 12B in accordance with an embodiment of the present invention.
Figure 12B:
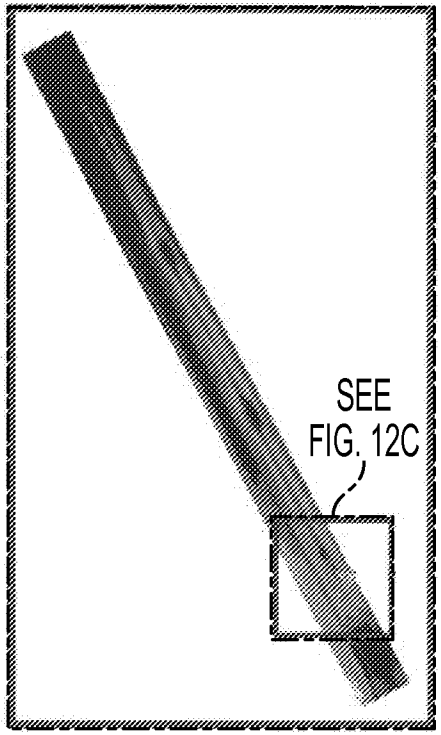
FIG. 12B is a magnified view of a "cutout" aluminum spline as shown in FIG. 12A in accordance with an embodiment of the present invention.
Figure 12A:
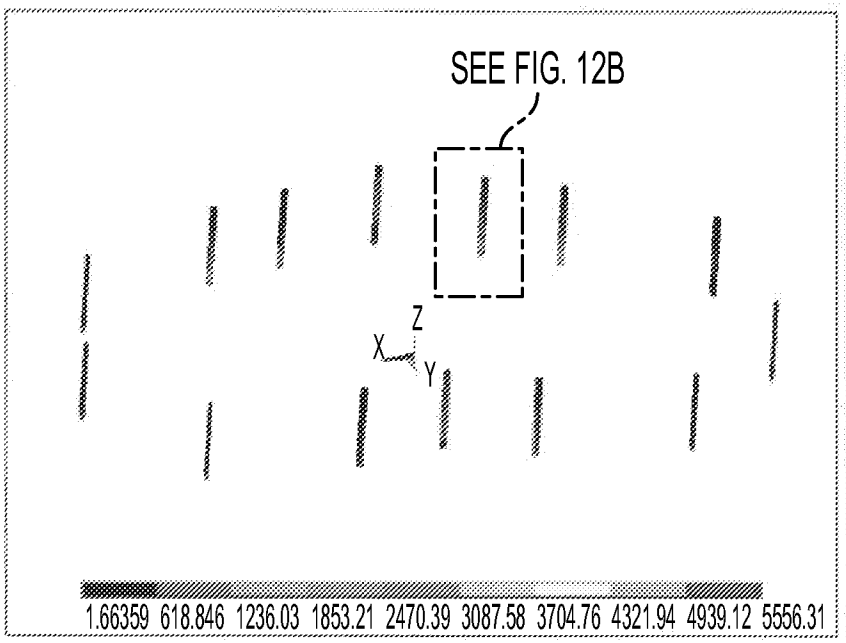
FIG. 12A is a von Mises stress plot illustration of an aluminum spline of a pool assembly in accordance with an embodiment of the present invention.
Figure 13B:
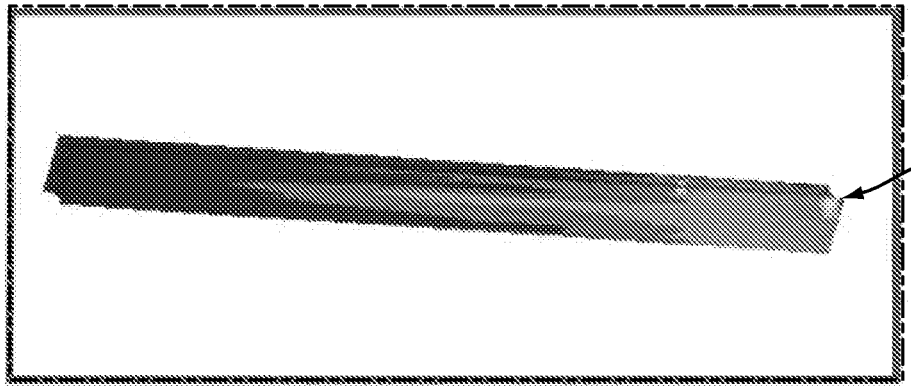
FIG. 13B is a magnified view of a "cutout" aluminum spline as shown in FIG. 13A in accordance with an embodiment of the present invention.
Figure 13A:
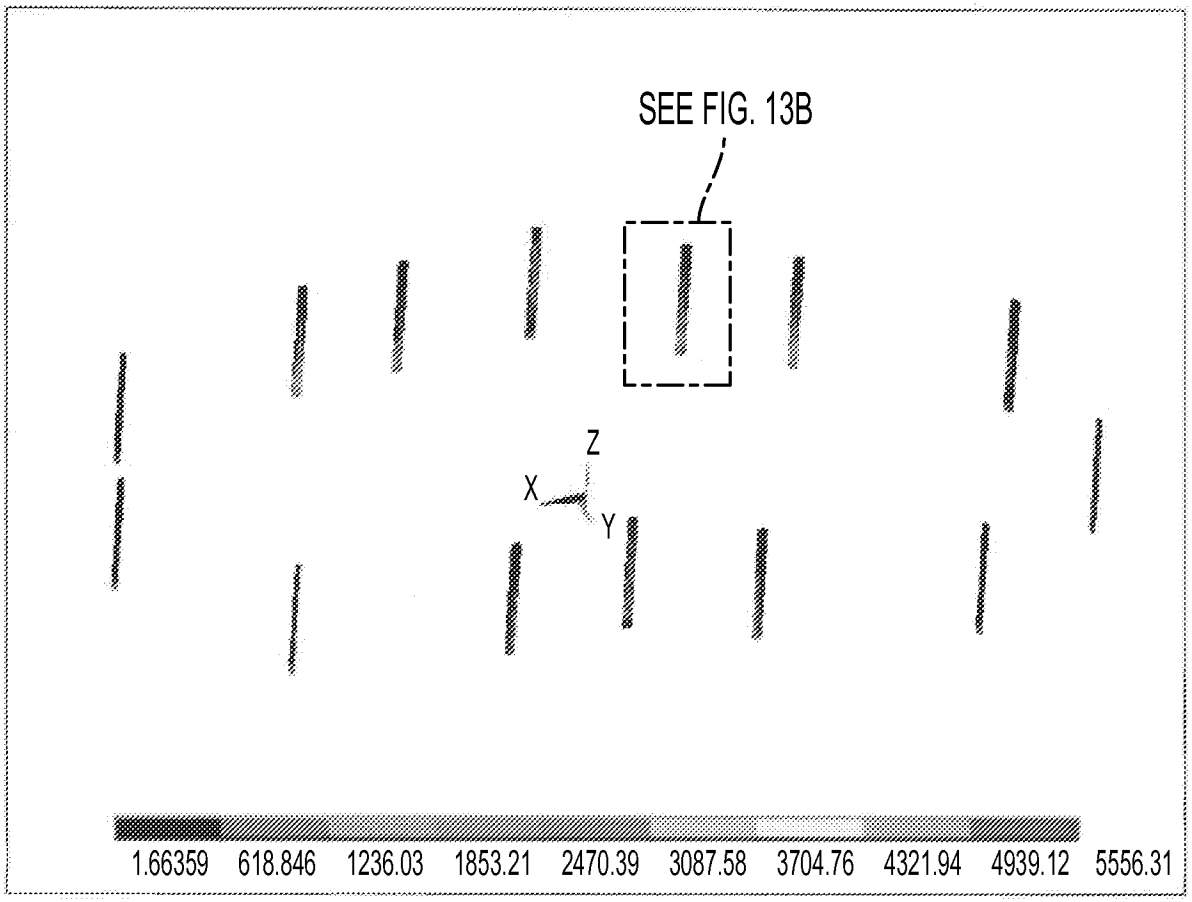
FIG. 13A is a von Mises stress plot illustration of an aluminum spline of a pool assembly in accordance with an embodiment of the present invention.

Similarly, FIG. 11 shows the stress of a convex aluminum panel is 5697 psi, resulting in a factor of safety of 3.69. FIGS. 12A-C and 13A-B show the maximum stresses of an aluminum spline are 5556 psi and 4509 psi at the highest points, yielding a stress factor 3.78 at the spline per the equation shown in Table 4 below.

TABLE 4

$$\text{SAFETY FACTOR} = \frac{\text{YIELD STRENGTH}}{\text{WORKING STRESS}} = \frac{21029.73}{5556} = 178$$

Figure 14B:
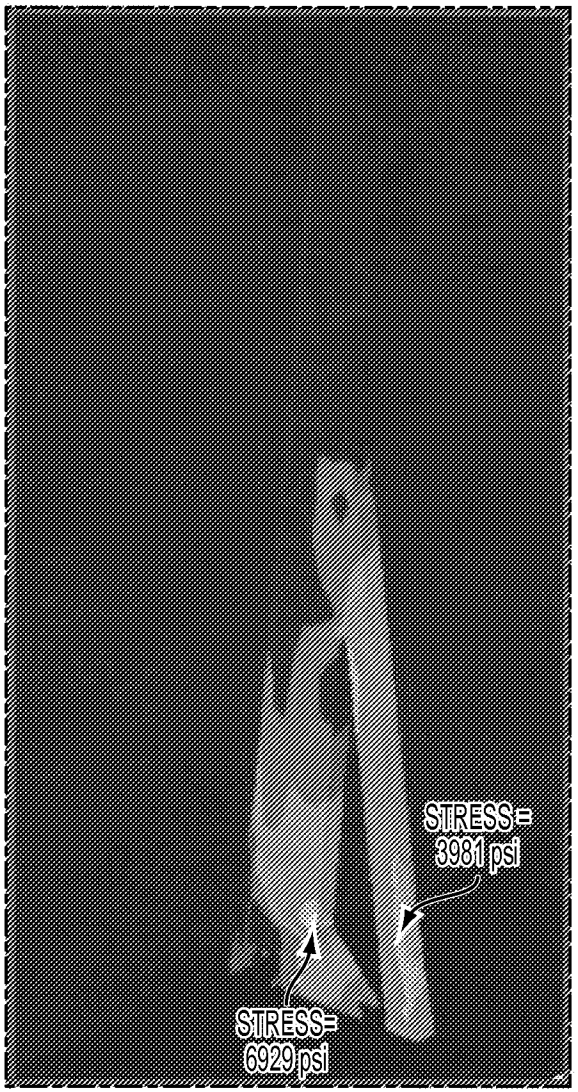
FIG. 14B is a magnified view of a "cutout" aluminum support as shown in FIG. 14A in accordance with an embodiment of the present invention.
Figure 14A:
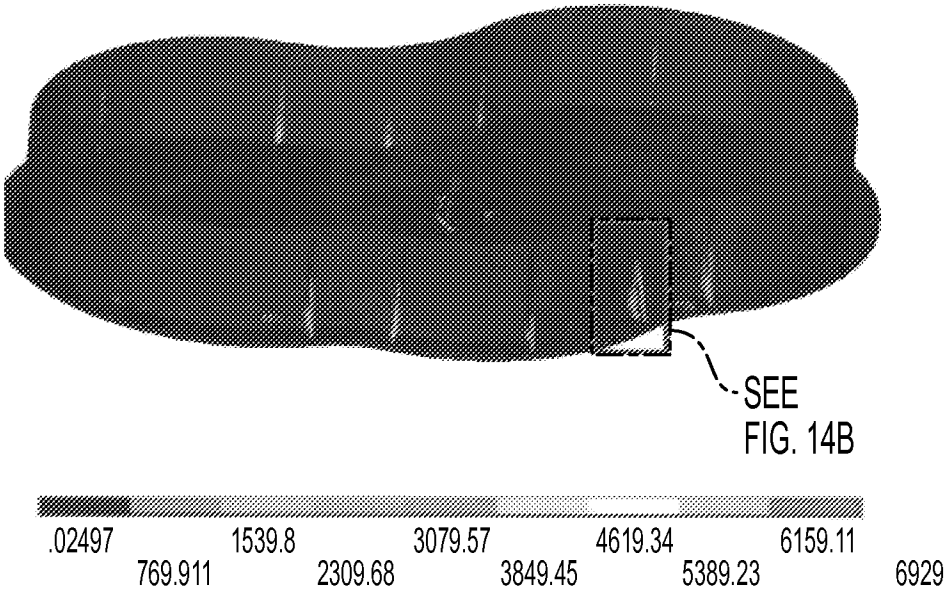
FIG. 14A is a von Mises stress plot illustration of aluminum supports of a pool assembly in accordance with an embodiment of the present invention.

FIGS. 14A-B show the stress of the aluminum A-frame supports are 6929 psi and 3981 psi at the highest points, resulting in a safety factor of 3.03 per the equation shown in Table 5 below.

TABLE 5

$$\text{SAFETY FACTOR} = \frac{\text{YIELD STRENGTH}}{\text{WORKING STRESS}} = \frac{21029.73}{6929} = 3.03$$

Figure 15:
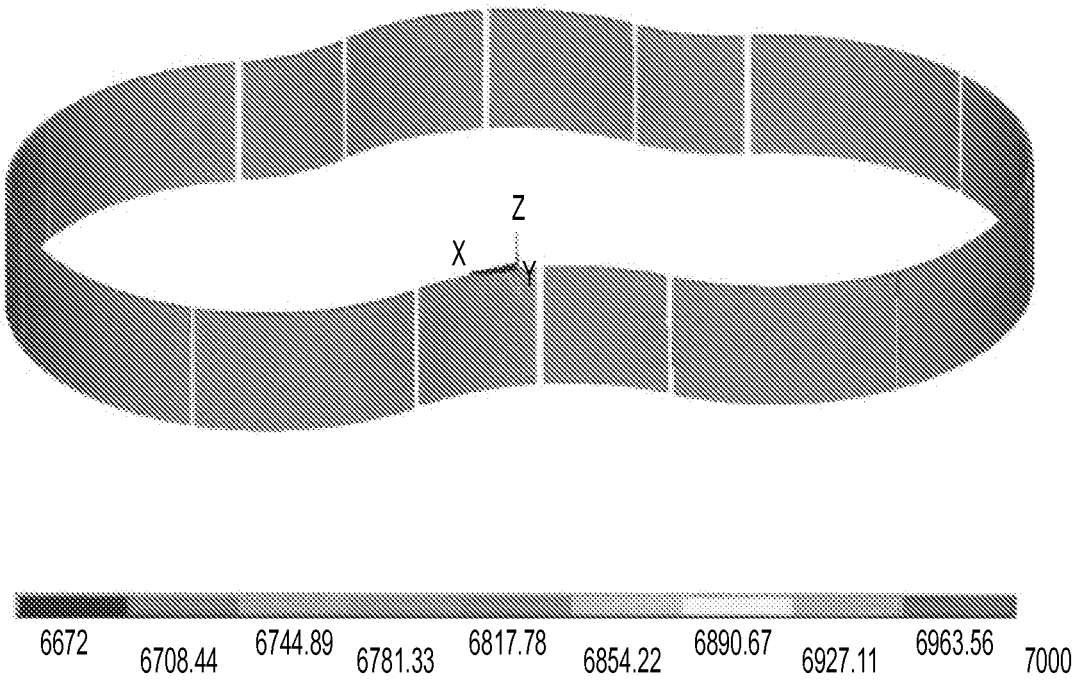
FIG. 15 is a von Mises stress plot illustration of a polystyrene foam layer of a pool assembly in accordance with an embodiment of the present invention.
Figure 16:
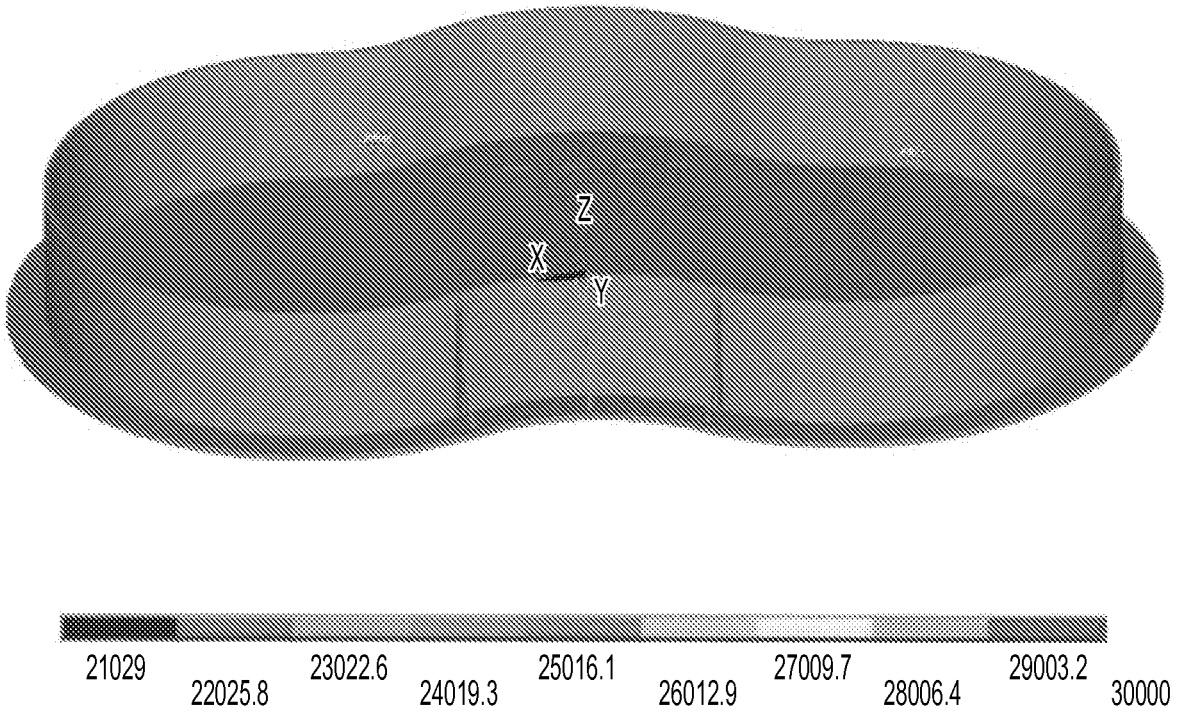
FIG. 16 is a von Mises stress plot illustration of a pool assembly in accordance with an embodiment of the present invention.

FIG. 15 shows a von Mises stress plot, for all stresses on the polystyrene foam layer rising above 6672 psi, demonstrating that at no point does the stress rise above 6672. Similarly, FIG. 16 shows a von Mises stress plot for all stresses on the pool assembly rising above 21029, demonstrating that no stresses rise above 21029 psi.

What is claimed is:

1. A swimming pool comprising:

a plurality of insulated panels, each of the plurality of insulated panels having an inner external skinning, an outer external skinning, and an internal insulating expanded foam between the inner external skinning and the outer external skinning;

a plurality of supports adapted to support at least some of the plurality of insulated panels;

wherein at least one of the plurality of insulated panels of the swimming pool comprises an insulated panel having an internal convex surface exposed to water pressure due to contact with water and an external exposed concave surface, wherein the external exposed concave surface comprises a substantially smooth and uninterrupted surface between two of the plurality of supports; and wherein the internal insulating expanded foam of the at least one of the plurality of insulated panels having the internal convex surface exposed to water pressure comprises an insulating expanded foam having a density adapted to withstand water pressure on the internal convex surface of the panel without failure of the panel.

2. The swimming pool as recited in claim 1, wherein the at least one of the plurality of insulated panels having the internal convex surface exposed to water pressure comprises at least two insulated panels having the internal convex surface exposed to water pressure.

3. The swimming pool as recited in claim 1, wherein the at least one of the plurality of insulated panels exposed to water pressure is supported by two of the plurality of supports.

4. The swimming pool as recited in claim 1, wherein the insulating expanded foam comprises one of an expanded polystyrene foam and an expanded urethane foam.

5. The swimming pool as recited in claim 1, wherein the external exposed concave substantially smooth and uninterrupted surface is not in contact with a support.

6. The swimming pool as recited in claim 1, wherein the swimming pool comprises an above ground swimming pool.

7. The swimming pool as recited in claim 1, wherein the swimming pool comprises a semi above ground swimming pool.

8. The swimming pool as recited in claim 1, wherein the plurality of insulated panels are connected by a plurality of panel joints, and wherein each of the plurality of panel joints comprises an elongated beam adapted to connect each of the plurality of panels to an adjacent panel, and wherein the elongated beam comprises an elongated flanged I-beam comprising a double web.

9. The swimming pool as recited in claim 1, wherein two of the plurality of supports are positioned at opposite ends of the at least one of the plurality of insulated panels having an internal convex surface exposed to water pressure.

10. The swimming pool as recited in claim 1, wherein the external, substantially smooth and uninterrupted, exposed concave surface is further devoid of backfill.

11. The swimming pool as recited in claim 1, wherein the inner external skinning and the outer external skinning each comprise one of a metal and a plastic.

* * * * *